US005647757A

United States Patent [19]

Chrysostomou

[11] Patent Number: 5,647,757

[45] Date of Patent: Jul. 15, 1997

[54] ELECTRICAL CONNECTOR WITH TERMINAL POSITION ASSURANCE

[75] Inventor: Chrysostomos Petros Chrysostomou, Enfield, Great Britain

[73] Assignee: The Whitaker Corporation, Wilmington, Del.

[21] Appl. No.: 617,229

[22] Filed: Mar. 18, 1996

[30] Foreign Application Priority Data

Mar. 20, 1995 [GB] United Kingdom ..... 9505697
Apr. 28, 1995 [GB] United Kingdom ..... 9508743

[51] Int. Cl.[6] ..... H01R 13/627

[52] U.S. Cl. ..... 439/352; 439/489; 439/188

[58] Field of Search ..... 439/188, 352, 439/353, 489, 351, 355, 357, 358

[56] References Cited

U.S. PATENT DOCUMENTS

| | | | |
|---|---|---|---|
| 3,639,890 | 2/1972 | Stevens et al. . | |
| 4,170,939 | 10/1979 | Hoheisel et al. | 102/28 S |
| 4,271,453 | 6/1981 | Yajima et al. | 361/248 |
| 4,435,742 | 3/1984 | Hetrick | 361/433 |
| 4,548,455 | 10/1985 | Ezure . | |
| 4,634,204 | 1/1987 | Detter et al. | 439/352 |
| 4,880,393 | 11/1989 | Moji | 439/352 |
| 4,915,642 | 4/1990 | Lin et al. | 439/352 |
| 4,929,189 | 5/1990 | Sekiguchi | 439/352 |
| 5,275,575 | 1/1994 | Cahaly et al. | 439/188 |
| 5,314,345 | 5/1994 | Cahaly et al. | 439/188 |

FOREIGN PATENT DOCUMENTS

| | | |
|---|---|---|
| 591 948 | 4/1994 | European Pat. Off. . |
| 432 368 | 11/1994 | European Pat. Off. . |
| 624 929 | 11/1994 | European Pat. Off. . |
| 632 546 | 1/1995 | European Pat. Off. . |
| 632 534 | 1/1995 | European Pat. Off. . |
| 650 229 | 4/1995 | European Pat. Off. . |
| 44 19 025 | 12/1994 | Germany . |
| 2 267 188 | 11/1993 | United Kingdom . |

*Primary Examiner*—Khiem Nguyen
*Assistant Examiner*—Yong Ki Kim

[57] ABSTRACT

An electrical connector matable with a base unit where the base unit has a plurality of contacts disposed within a socket, the connector comprises; a housing having a body, a plug extending outward from the body that is receivable in the socket, and a deflectable retention member extending outward from the body alongside and spaced from the plug for engaging a retention feature in the base unit to retain the connector therewith; contacts disposed within the housing and accessible through the plug for engaging the contacts of the base unit when the connector is mated therewith; a slide slidably mounted to said housing and movable between a first position and a second position; and a support element responsive to slide movement that includes an extension that in the first position of the slide is disposed clear of the retention member for mating and demating of the connector and base unit and in the second position the extension is disposed between the retention member and the plug thereby preventing deflection thereof to prevent mating or demating; the connector being characterized in that the extension is displaceable axially along the retention member and plug in response to movement of the slide between the first position and the second position.

10 Claims, 10 Drawing Sheets

ELECTRICAL CONNECTOR WITH TERMINAL POSITION ASSURANCE

BACKGROUND OF THE INVENTION

1. Field of the Invention

The present invention relates to electrical connectors, and in particular the electrical connector used at the base unit initiator (SQUIB) in a inflatable (airbag) restraint system incorporated into contemporary vehicles.

2. Description of the Prior Art

The initiators of the inflatable restraint systems must be interconnected with a controller that will provide the signal necessary to activate the initiator when required. The interconnection at the initiator must be sufficiently robust that the interconnection is maintained in a reliable manner. However, it is desirable that the interconnection not be permanent as it may be necessary to replace the initiator. Finally, the interconnection must be one that is simple and easy to install due to the large number of vehicles incorporating interconnections of this type where the installation may typically occur along a manufacturing assembly line process.

U.S. Pat. No. 5,314,345 discloses an electrical connection system particularly suited for the application described above. The initiator carries a pair of male connector elements that are to be releasably mated with a pair of female connector elements carried by an electrical connector component. A shorting clip is associated with the initiator for providing an electrical short between the male connector elements, as is common in these application, whereby an inadvertent potential may not be established across the elements. The shorting clip is displaceable out of the shorting position when the connector is mated therewith. The connector includes a housing and a perpendicularly extending plug for receiving the male pins where resilient latch means for providing an mechanical latch with the initiator are spaced from and extend along the plug. A separate locking element is provided which is insertable into a locked position between the latch and plug when the initiator and connector are mated for preventing disengagement therebetween. As described, the locking element is preferably tethered to the connector and may be placed into an opening to maintain the resilient latches inforced engagement with the initiator. In U.S. Pat. No. 5,275,575 the locking element is further used to defeat the short circuit after the connector is mated with the base unit of the initiator.

EP-A-0 632 534 also describes a connector suited for the application described above. The electrical connector described includes a connector housing having a plug extending therefrom for mating with the initiator and resilient latch arms on either side thereof and extending therealong in a spaced manner. The resilient latch arm engages a complementary recess in the initiator. A slidable cover that is displaceable between first and second positions includes blocking elements which are movable transversely into the space between the plug and the resilient arms to prevent disengagement with the initiator.

While the aforementioned designs preform adequately enough, there are a number of areas where it would be desirable to effect improvements. In the first described system, a separate locking element must be inserted into the locked position in the connector to prevent release. As the element is separate, this increases the likelihood that the locking component may be lost or not assembled during the installation procedure. In the second connector, the sliding cover includes the blocking elements which results in a complex moulding. In addition, the geometrical confines of having a transversely movable locking element extending from the cover make it difficult to manufacture a robust assembly that provides the support necessary along the resilient arms. Furthermore, with transverse movement it is possible that the blocking elements become jammed as a result of some debris or foreign material obstructing the mechanism.

SUMMARY OF THE INVENTION

Therefore, it is an object of the present invention to provide an electrical connector for interconnecting with a base unit that is of compact construction, is releasably interconnected to the base unit, and includes means to assure that the connector is reliably held respective to the base unit.

These and other objects are accomplished by providing an electrical connector terminatable to a conductive pathway for interconnection thereof to conductors within a base unit, the connector comprising a housing having a body portion for receiving interconnection elements therein, a plug extending outward from the body and being receivable by the base unit, and a retention member extending outward from the body and being receivable by a retention feature in the base unit to retain the connector therewith; a slide movable along the body between a first position and a second position; and a support element responsive to the slide and including extensions that are clear of the retention member in the first position for mating and demating of the connector in the base and wherein the second position the support element supports the retention member to prevent demating therebetween, the connector characterized in that the extensions are displaceable axially along the retention member in the direction the retention member extends from the body between the first and second positions.

Advantageously, the electrical connector according to the present invention is compact and of economical construction. It is another advantage that the extensions used to support the retention member are displaceable axially therealong in response to displacement of the slide. It is yet another advantage of the present invention that the extensions may be disposed between a plug and the retention members, whereby they are protected from damage.

In addition, it would be advantageous to provide switch means for disabling the air bag actuating circuit so long as the slide remains in its first position and for enabling the circuit when the slide has been moved to its second position in which the connector is locked to the base unit. A warning lamp on the dash board of the vehicle may be arranged to be illuminated when the circuit is disabled so that the vehicle cannot exit a production line without indication that the connector has not been locked to the base unit.

To similar effect the air bag actuating circuit may be disabled in the first position of the slide by means of a short-circuiting link bridging the conductors of the base unit, the connector having means for displacing the short circuiting link from the conductors when the slide is moved to its second position.

The slide may be provided with a contact for short circuiting the terminals until the slide has been moved to its second position.

Leads for connecting the terminals to the sensors may be passed through bores in a ferrite filter bead before being connected to the terminals and the bead lodged in the housing.

DETAILED DESCRIPTION OF THE PREFERRED EMBODIMENT

Figure 1:
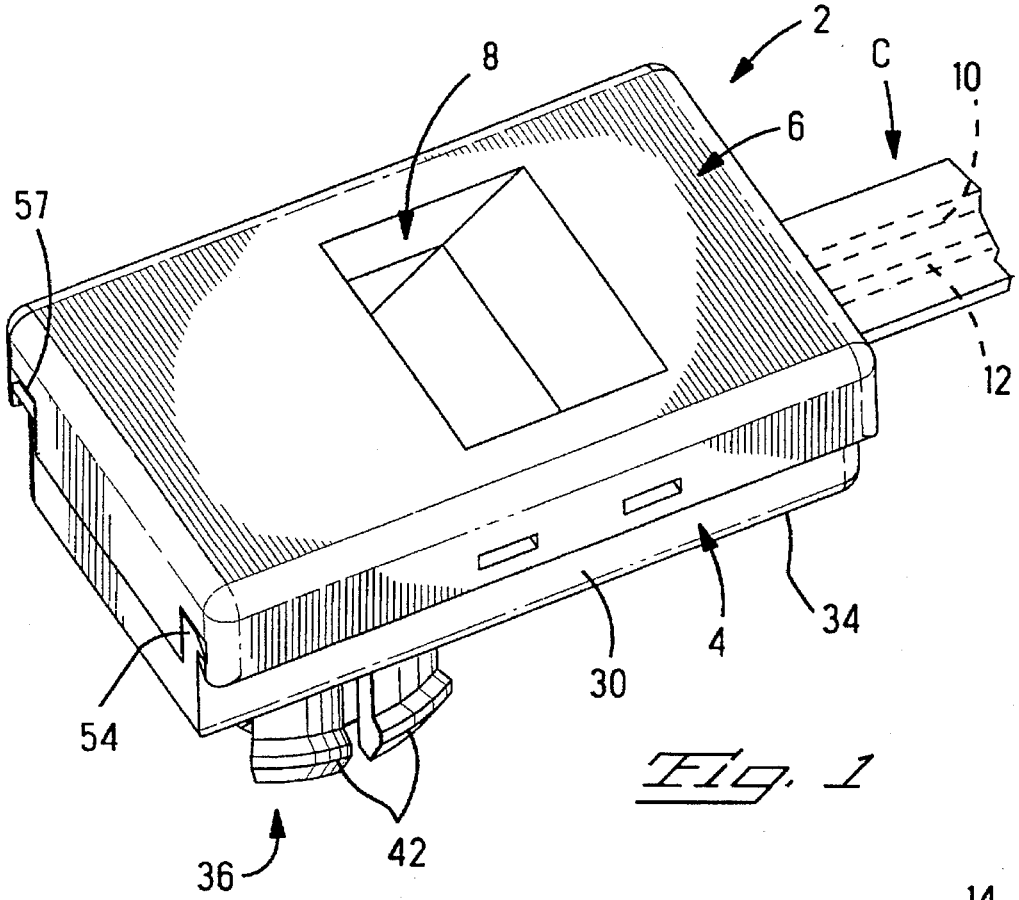
FIG. 1 is an isometric view of an electrical connector according to a first embodiment for mating with a base unit in an inflatable air bag restraint system for an automotive vehicle.

As shown in FIG. 1, an electrical connector according to a first embodiment of the invention, which is generally referenced 2, comprises an insulating housing 4 with a displaceable insulating slide 6 thereon. The slide 6 has therein a support element 8 (best seen in FIG. 5) which is responsive to relative movement between the slide 6 and the housing 4 and which is also made of an insulating material. In the present embodiment the connector 2 terminates insulated electrical leads 10 and 12, of a jacketed cable C.

Figure 2:
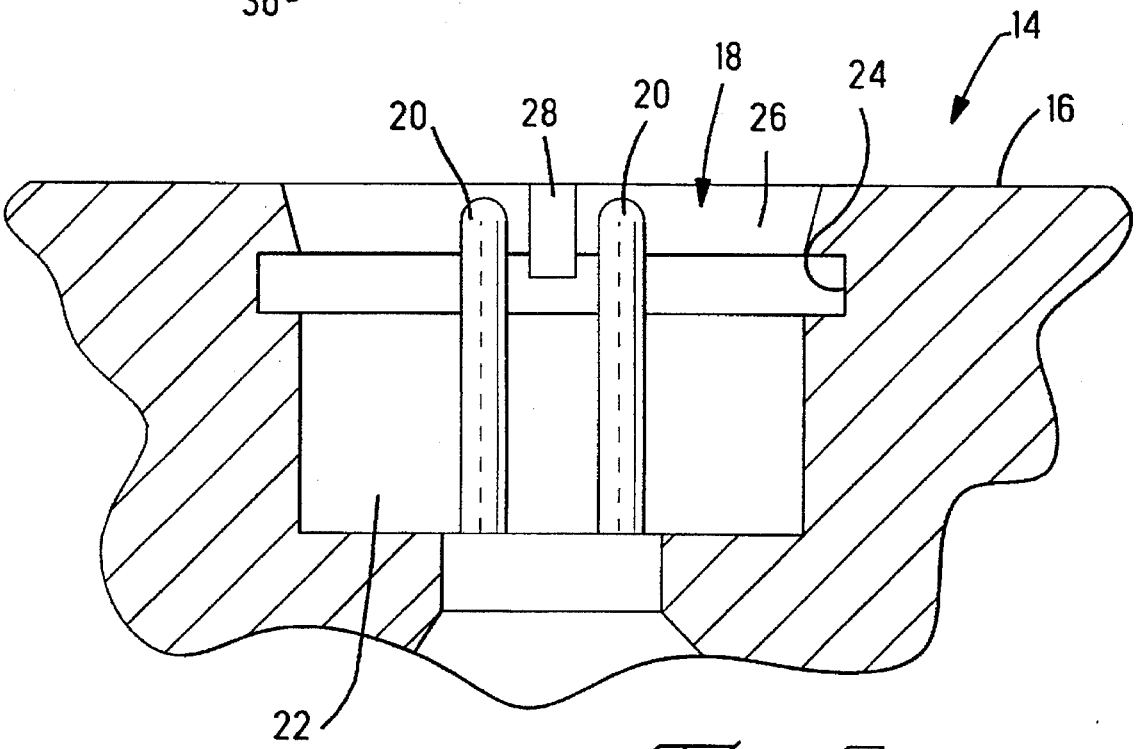
FIG. 2 is a fragmentary sectional view of the base unit showing a socket with which the connector is matable.

As shown in FIG. 2, a base unit generally referenced 14 comprises a body portion 16 defining a socket 18. Within the socket 18 is a pair of conductors in the form of pins 20 connected to, for example, an air bag igniter of the kind generally known as a squib of an air bag actuating circuit to sensors of which the leads 10 and 12 are connected. The socket 18 has a plug receiving region 22, above in which is a retention feature 24, in the present embodiment, a circular section cylindrical groove undercut relative to the plug receiving region 22. Above the retention feature 24 the socket has an outwardly flared lead in mouth 26. The socket 18 may have a key 28 in the mouth 26 for correct orientation of the mating connector 2 with respect to the conductors 20.

Figure 3:
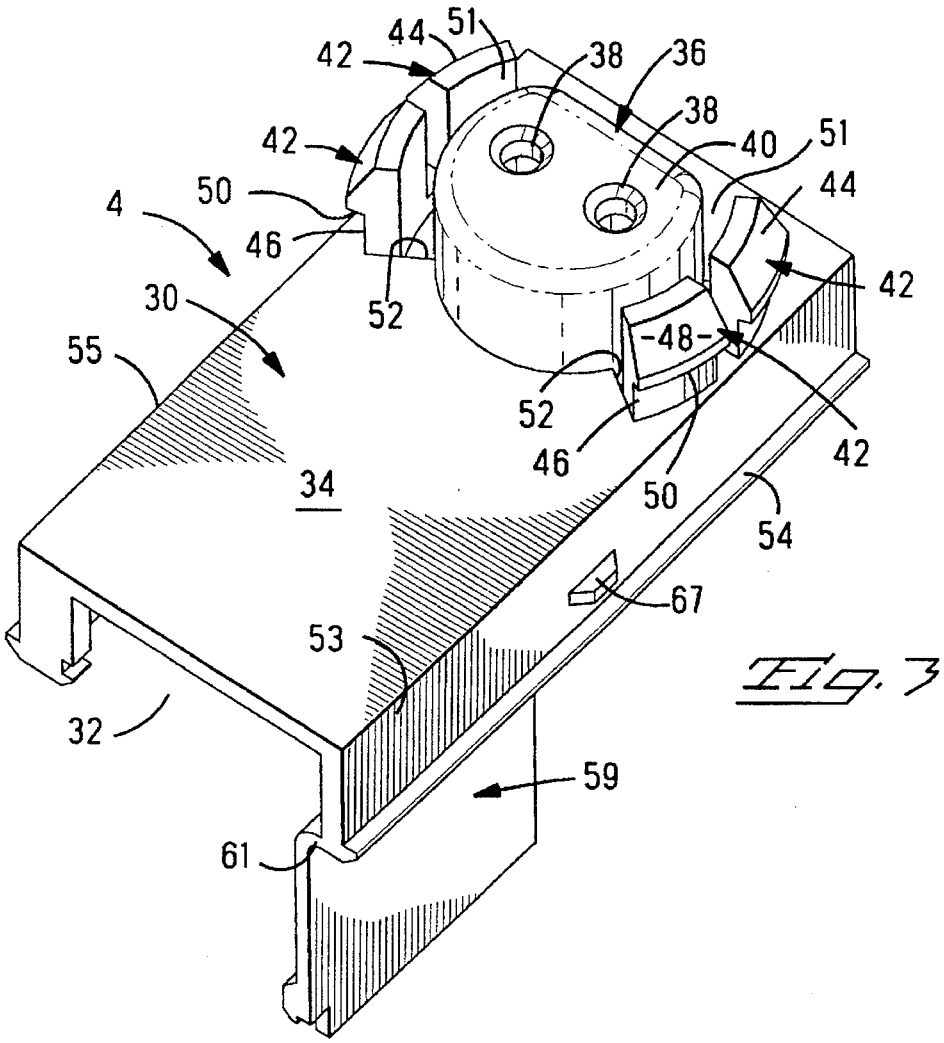
FIG. 3 is an isometric view taken from below, of a housing of the connector with a lid of the housing in an open position.
Figure 4:
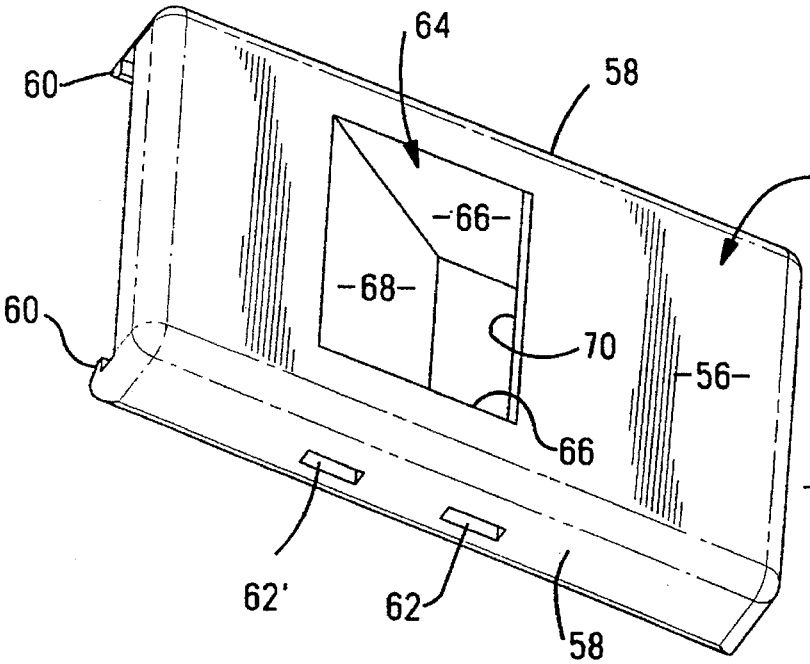
FIG. 4 is an isometric view taken from above of a slide of the housing.
Figure 5:
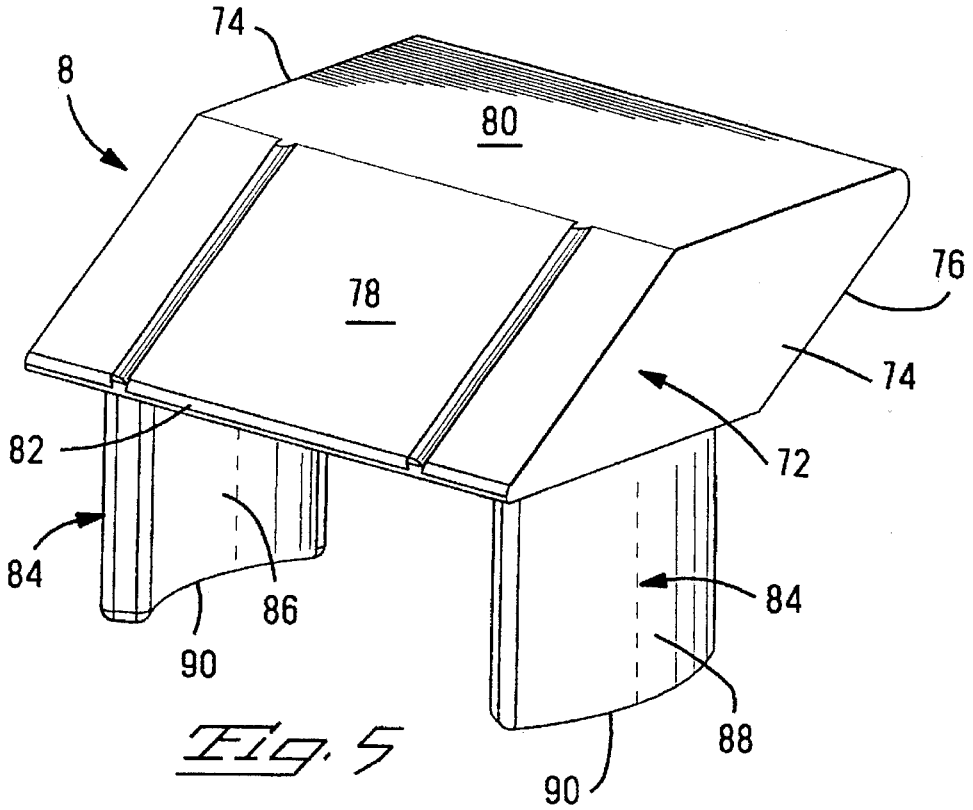
FIG. 5 is an isometric view of a support element of the connector.
Figure 10:
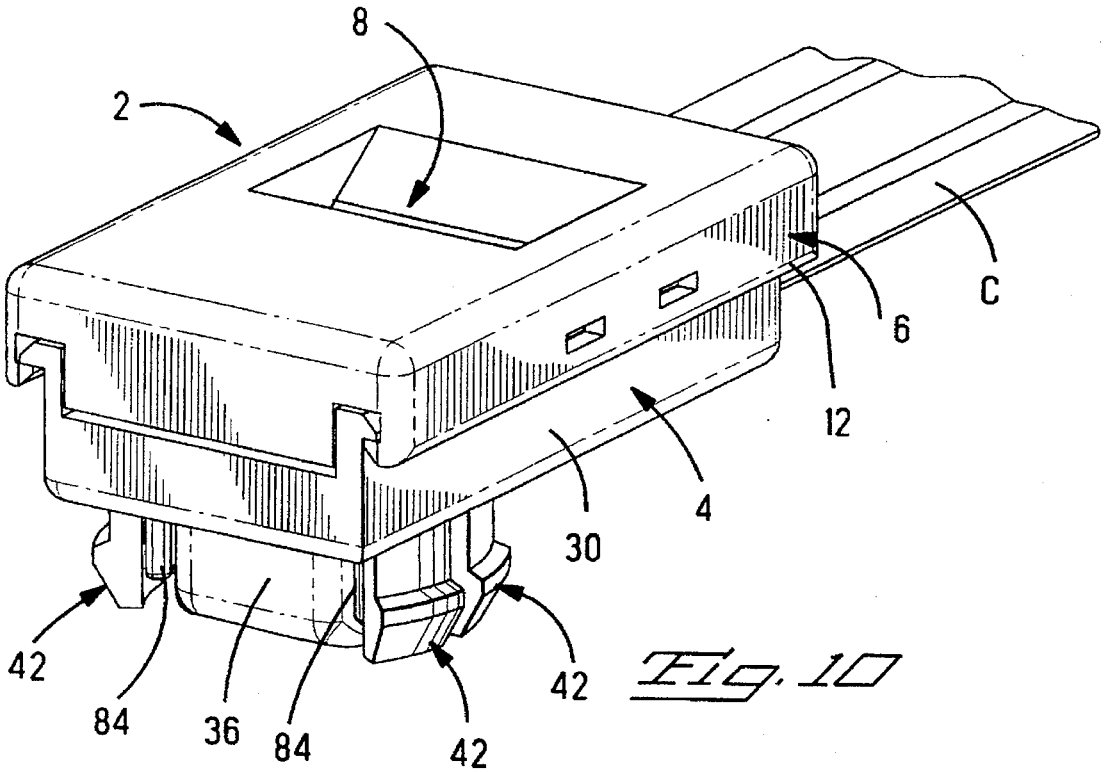
FIG. 10 is an isometric view taken from the side, of the connector with the support element in its second position.
Figure 8:
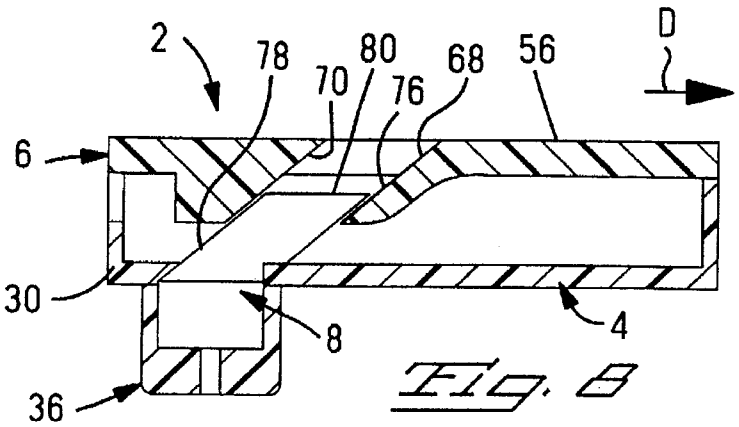
FIG. 8 is a similar view to that of FIG. 6 but showing the support element in a second position to prevent the connector from being unmated from the base unit.
Figure 11:
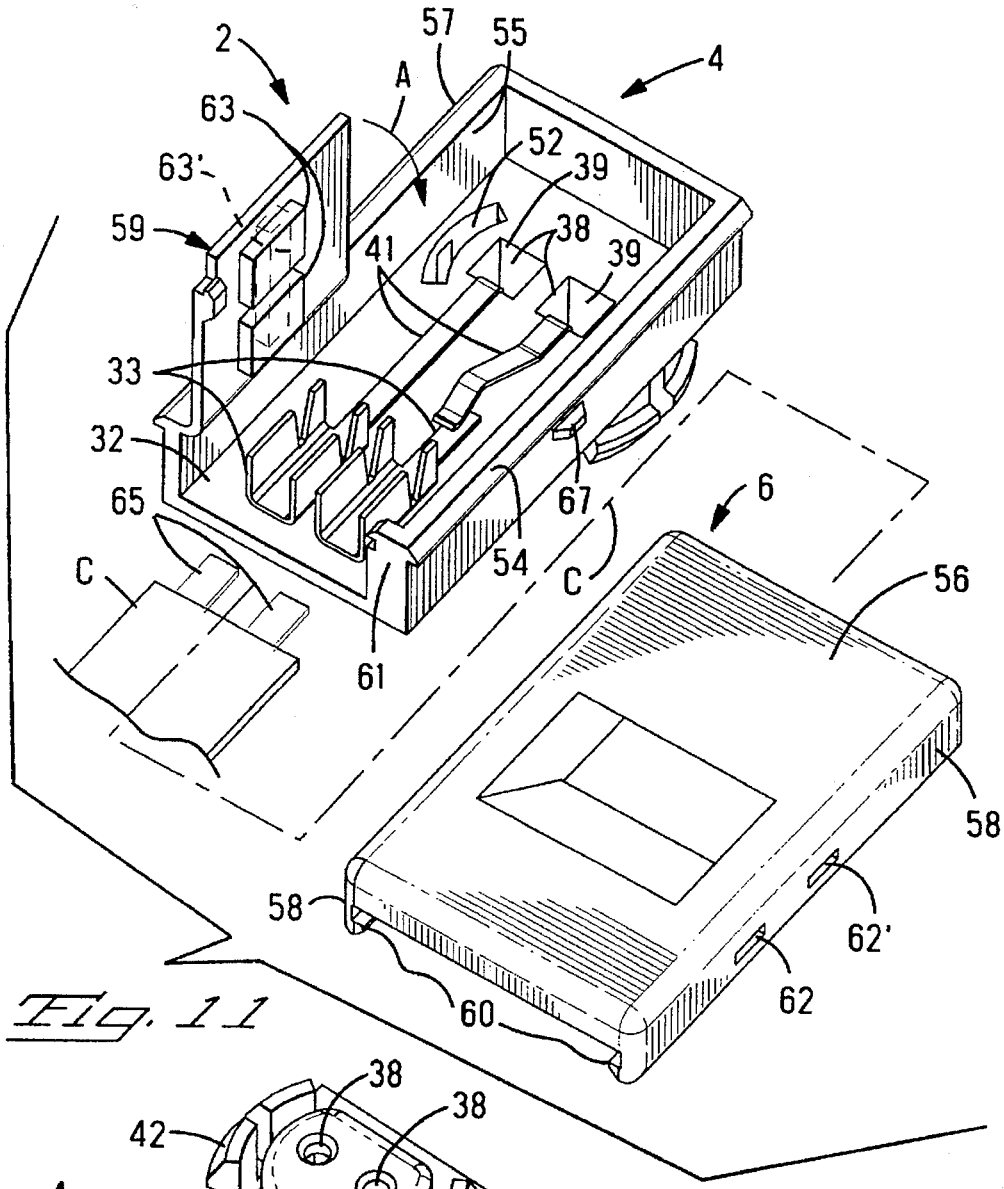
FIG. 11 is a diagrammatic, exploded, isometric view of the connector showing electrical terminals in the connector housing, with the lid of the housing in an open position.
Figure 12:
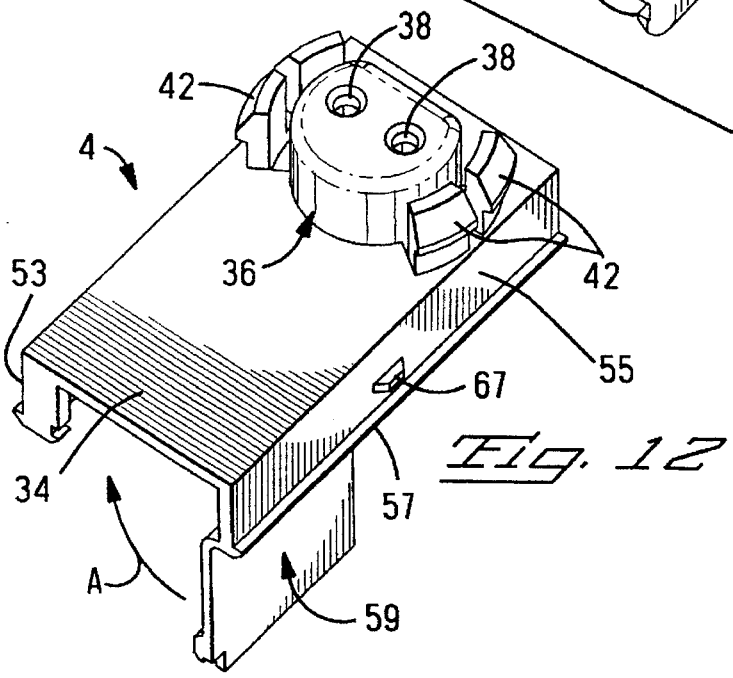
FIG. 12 is an isometric view of the housing taken from below, with the lid in its open position.

As shown in FIG. 3, the housing 4 has a body portion 30 having an underside 34 from which depends a plug 36 for mating with the socket 18. There open into the bottom face 40 of the plug 36 a pair of openings 38 for receiving the conductors 20 of the socket 18 and providing access to socket contacts 39 of electrical terminals 41 (FIG. 11) located in grooves 33 in the open interior 32 of the housing 4. There depend from the underside 34 of the housing 4 retention members 42, which in this embodiment are resiliently deflectable arms 46 formed integrally with the body portion 30 of the housing 4. The arms 46 have latch heads 44 at their ends remote from the underside 34. Each latch head 44 has a leading camming surface 48 and a retention shoulder 50 spaced back therefrom. There are defined between the retention members 42 and the plug 36, openings 51. Through cutouts 52 in the bottom of the body portion 30 are aligned with the openings 51. Side walls 53 and 55 of the body portion 30 are surmounted by opposite slide rails 54 and 57, respectively. The slide rail 54 extends substantially half way along the length of the housing 4 in the rearward direction, up to a lid 59 having a flexible hinge portion 61 formed integrally with the side wall 53. Upon the inner face of the lid 59 are a pair of terminal position assurance ribs 63 (FIG. 11) which are elongate lengthwise of the housing 4. When the leads 10 and 12 have been connected to the terminals 41 at connections 65, the lid 59 is flipped over as indicated by the arrow A in FIG. 11 and FIG. 12 so that the rear end portion of the housing 4 is closed by the lid 59. The ribs 63 assure that the lid 59 can only be seated on the housing if the terminals 41 are correctly located in their grooves 33, as may not occur for example, if the terminals have been bent. The ribs 63 may be replaced, for example, by a single rib 63', shown in broken lines in FIG. 11, which extends transversely of the length of the housing 4. As best seen in FIGS. 4 and 11, the slide 6 has an upper wall 56 and side walls 58 provided with gibs 60 which provide slide tracks for receiving the respective rails 54 and 57, thereby enabling the slide 6 to be displaced along the housing 4 between a first and a second position as will be described below. The first and second positions are established by means of pairs of latching openings 62 and 62' in the side walls 58, each pair of which cooperates with a single latching boss 67 on each side wall 53 and 55 of the housing 4. An opening 64 extending through the upper wall 56 of the slide 6 has generally upstanding opposed side walls 66 and first and second opposed camming surfaces 68 and 70, for a purpose described below. As best seen in FIG. 5, the support element 8 comprises a head 72 with upstanding opposed side walls 74 which are spaced apart for sliding reception in the opening 64 of the slide 6 between the side walls 66. The side walls 74 are interconnected by first and second camming surfaces 76 and 78, respectively, which correspond to the first and second camming surfaces 68 and 70, respectively, of the slide 6. The surfaces 74, 76 and 78 are interconnected at their upper ends, by a top surface 80 and at their lower ends by a base 82. There depend from opposite sides of the base 82, respective support extensions 84. Each extension 84 has an arcuate inner surface 86 corresponding to the curvature of the plug 36 of the housing 4. Each extension 84 also has an arcuate outer surface 88 corresponding to the curvature of the inner surfaces of the latch members 42 of the housing 4. Each support extension 84 has a free end 90.

Figure 6:
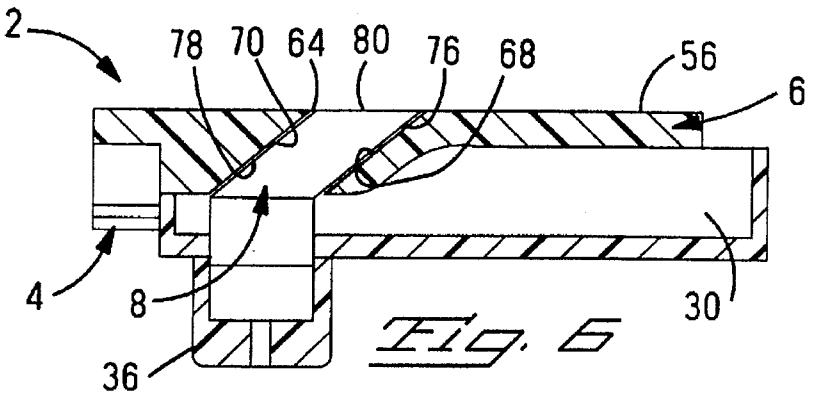
FIG. 6 is a diagrammatic, fragmentary, sectional view of the connector showing the support element in a first position allowing the connector to be mated with and unmated from a base unit.

The functioning of the electrical connector 2 will now be described with particular reference to FIGS. 6 to 12. The terminals 41 having been assembled to the housing 4 and the lid 59 flipped to its closed position, the slide 6 is mounted on the housing 4 and the support element 8 is positioned in the opening 64 of the slide 6 so that the camming surfaces 68 and 76 face each other, and the camming surfaces 70 and 78 also face each other. In this first position of the support element 8, which is shown in FIG. 6, the top surface 80 thereof lies substantially flush with the upper wall 56 of the slide 6. The element 8 may be made in a contrasting colour to that of the slide 6 to provide a visual indication that the support element 8 is in its first position.

Figure 9:
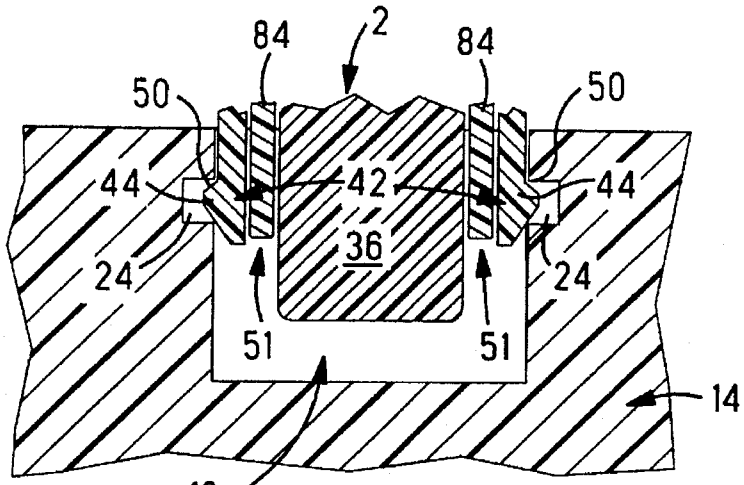
FIG. 9 is a similar view to that of FIG. 7 but showing the support element in the second position to prevent the connector from being unmated from the base unit.
Figure 7:
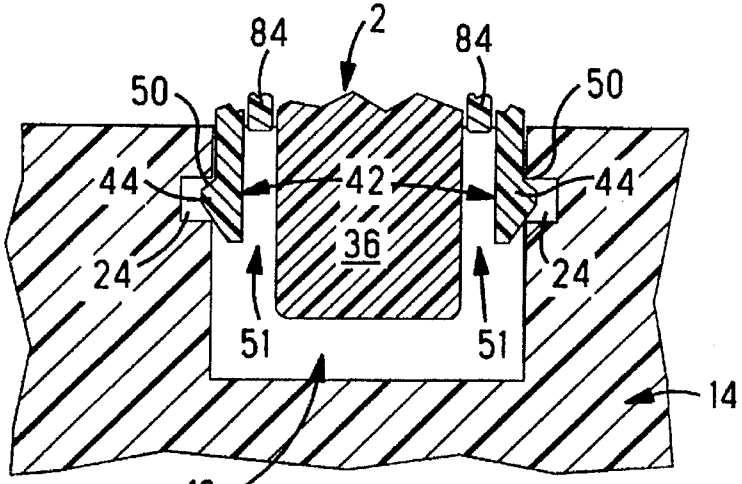
FIG. 7 is a diagrammatic, fragmentary, sectional view through the connector and the base unit showing a retention member engaged in a retention feature of the socket with the support element in said first position.

FIG. 7 shows the plug 36 mated with the socket 18 of the base unit 14. A respective retention member 42 is shown with its latch head 44 received within the retention feature 24 of the socket 18. As the retention shoulder 50 of the head 44 is downwardly inclined, the connector 2 can be unmated from the socket 18 by withdrawing the connector 2 in the direction of the arrow B in FIG. 7, the retention member 42 being free to deflect into the adjacent opening 51. As shown in FIG. 7, the respective extension 84 of the support element 8 is in a raised position relative to the latch head 44. In this first position of the support element 8, the plug 36 can be either mated or unmated with the socket 18. In order to locate the slide 6, and thus the support element 8, in their first positions, the slide 6 is applied to the housing 4 in the direction of the arrow C in FIG. 11 so that the rearmost latching openings 62' of the side walls 58 of the slide 6 are latchingly engaged by the respective bosses 67 on the side walls of the housing 4. The slide 6 and the element 8 can be moved to their second positions (FIGS. 8 and 9) by advancing the slide 6 in the direction of the arrow D in FIG. 8 so that the latching openings 62 of the slide 6 are latchingly engaged in by the bosses 67 of the housing 4. In response to the advance of the slide 6 in the direction of the arrow D, the support element 8 is displaced downwardly in the slide 6 by the interaction of the camming surfaces 70 and 78 and the top surface 80 of the element 8 is no longer visible, since it now lies below the upper wall 56 of the slide 6. As shown in FIG. 9 each extension 84 is displaced downwardly into the respective opening 51 so as to protrude behind the respective latch head 44 thereby preventing displacement thereof, so that the connector cannot be withdrawn from the socket 18. Thus when the connector 2 is in use in a vehicle, the air bag actuating circuit cannot be inadvertently disabled, that is to say the circuit between the crash sensors of the vehicle, connected to the leads 10 and 12, and the conductors 20 of the base unit 14 which are connected to the air bag igniter. The lid 59 ensures that the circuit is not deactivated as a result of faulty positioning of the terminals 41. Although it is advantageous that the lid 59 be formed integrally with the housing 4, the lid may alternatively be provided as a separate item, as will be described below.

Figure 13:
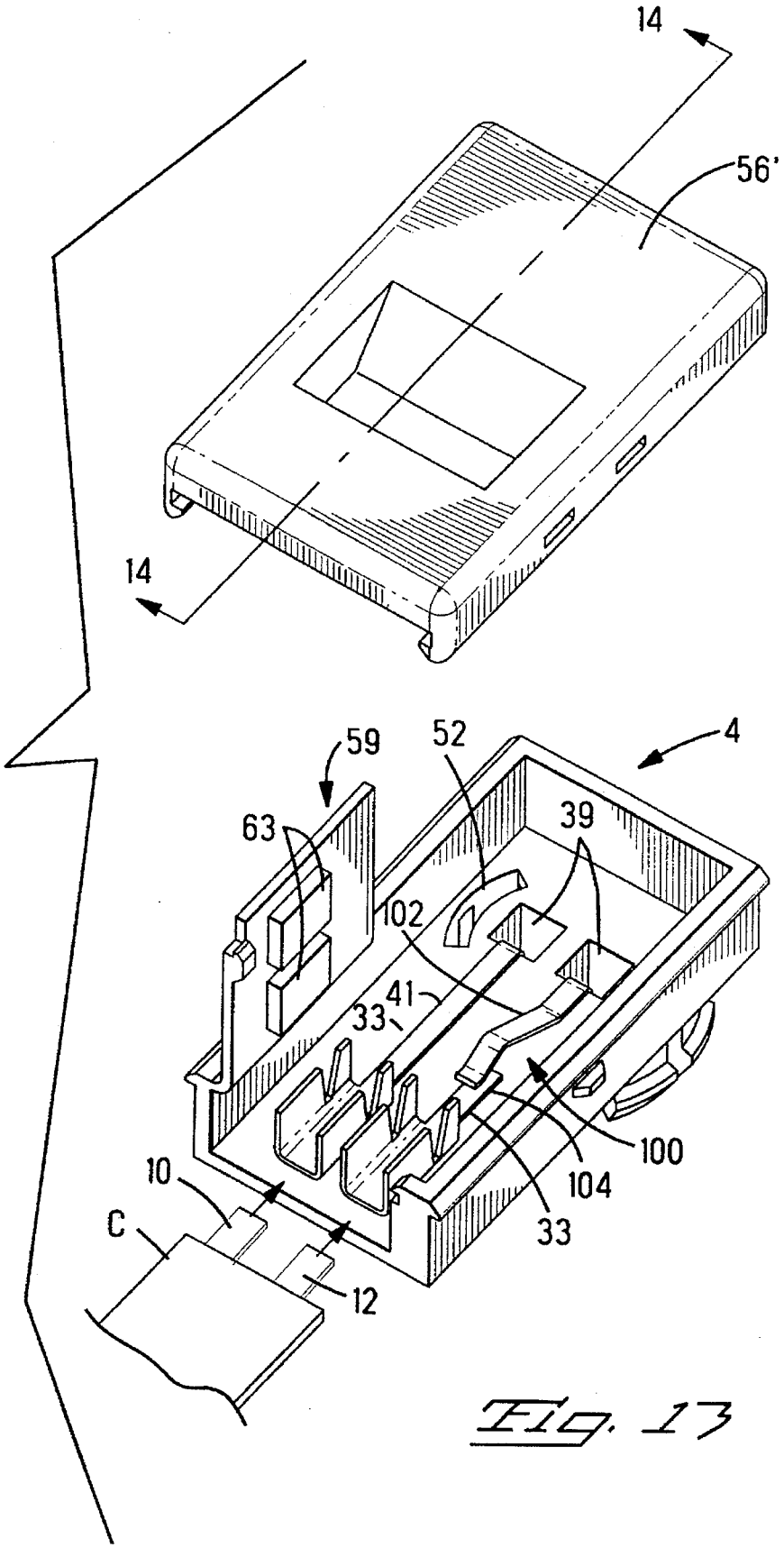
FIG. 13 is a similar view to that of FIG. 11 but showing another embodiment of the connector.
Figure 16:
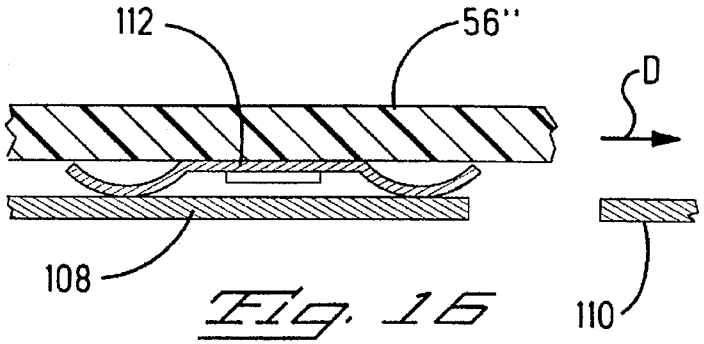
FIGS. 16 and 17 are fragmentary sectional views showing an alternative means for opening and closing such a switch, FIG. 16 showing the switch open and FIG. 17 showing the switch closed.
Figure 17:
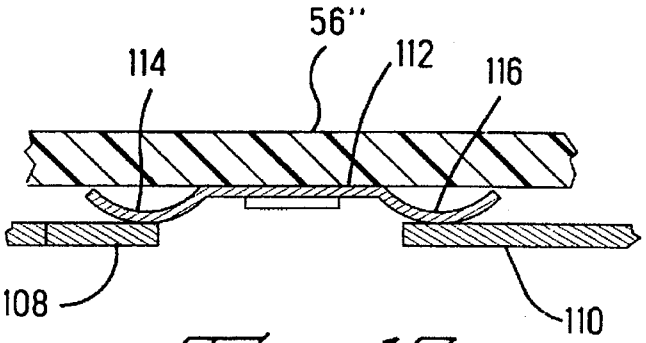
Figure 14:
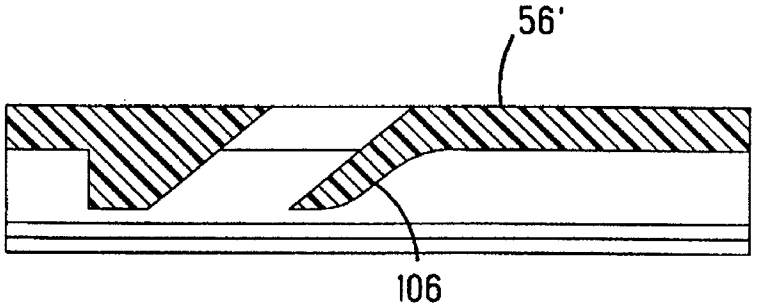
FIG. 14 is a view taken on the lines 14—14 of FIG. 13 showing a switching ramp on the side of the housing.
Figure 15:
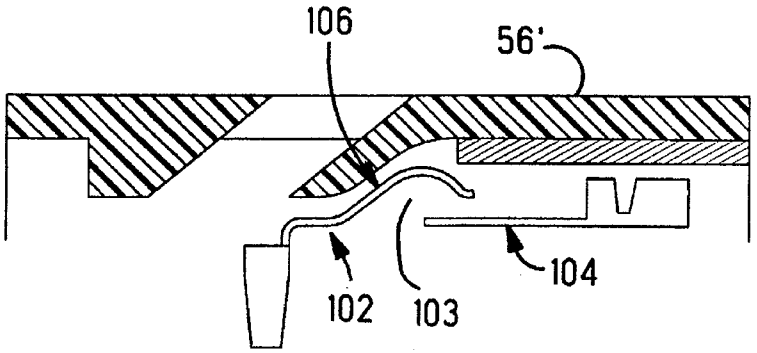
FIG. 15 is a fragmentary, longitudinal, sectional view through the slide showing the switching ramp prior to closing a switch incorporated in one of the terminals of the connector of FIG. 13.

Another embodiment of the electrical connector will now be described with reference to FIGS. 13 to 15 in which parts which are similar to those described above bear the same reference numerals thereas. As shown in FIGS. 13 and 15, the housing 4 contains a first terminal 41, and a second terminal 100 comprising two parts 102 and 104, respectively. The part 102 comprises a resilient switch arm 103 as best seen in FIG. 15 for connection to a respective conductor 20 of the socket 18. The part 104 acts as the fixed contact of the switch so provided. As shown in FIGS. 14 and 15, the upper wall 56' of the slide is formed with an obliquely inwardly projecting switch actuating ramp 106 which is forwardly inclined. When the slide is in its first position, the switch arm 103 is displaced from the fixed contact part 104 so that the air bag actuating circuit is broken. When the slide is advanced to its second position to lock the connector to the base unit 14 the ramp 106 drives the switch arm 103 of the terminal 100 against the fixed part 104 so that the air bag actuating circuit is made. Thus the air bag actuating system is inoperative until the connector has been locked to the base unit. When the switch provided by the parts 102 and 104 is in the broken condition, it may be arranged that a warning lamp on the dash board of the vehicle is illuminated. Thus should the vehicle exit a production line with the connector unmated, or only partially mated, with the base unit, that will be apparent from the illumination of the warning lamp on the dash board of the vehicle. According to another and equivalent embodiment which is shown in FIGS. 16 and 17, one of the terminals comprises two rectilinear parts 108 and 110, respectively, which lie in the same plane, the top wall 56" of the slide having a bridge contact 112 fixed thereto. As shown in FIG. 16, in the first position of the slide, the bridge contact 112 engages only the portion 108 of the terminal. When the slide is advanced in the direction of the arrow D, into its second position, the bridge contact 112 bridges the portions 108 and 110 of the terminal. Thus in said first position, the air bag actuating circuit is broken and in said second position the circuit is made. In the present example, the contact 112 comprises a pair of spaced bights 114 and 116 respectively, one for engaging each of the terminal portions 108 and 110 in the second position of the slide. The slide may have a contact (not shown) for short circuiting the terminals until the slide is moved to its second position.

Figure 18:
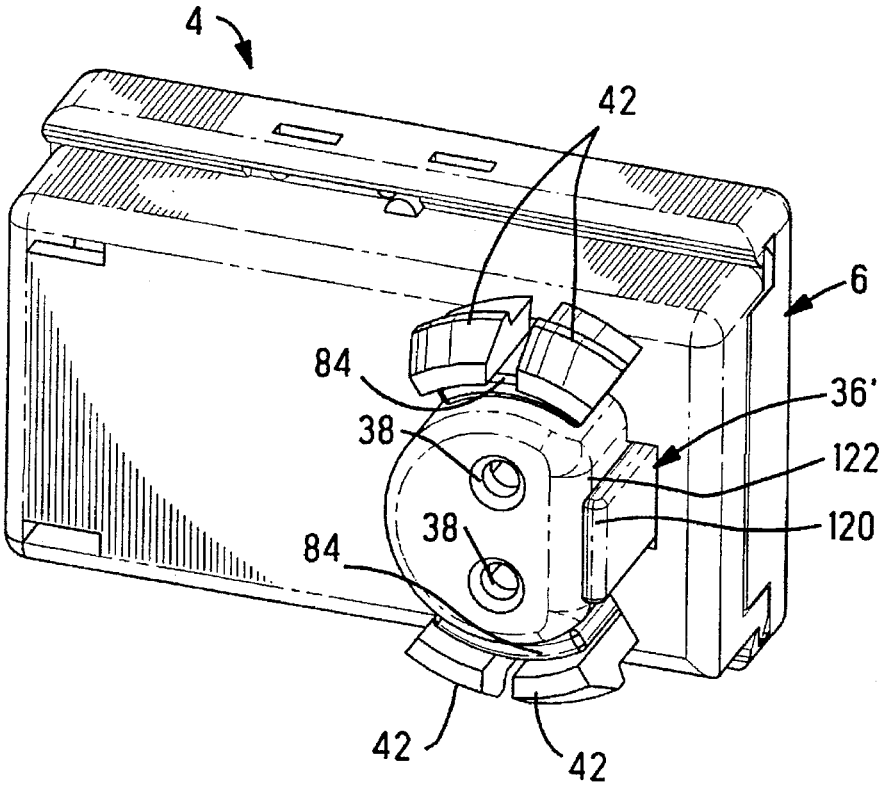
FIG. 18 is an isometric view taken from below of a further embodiment of the connector.
Figure 19:
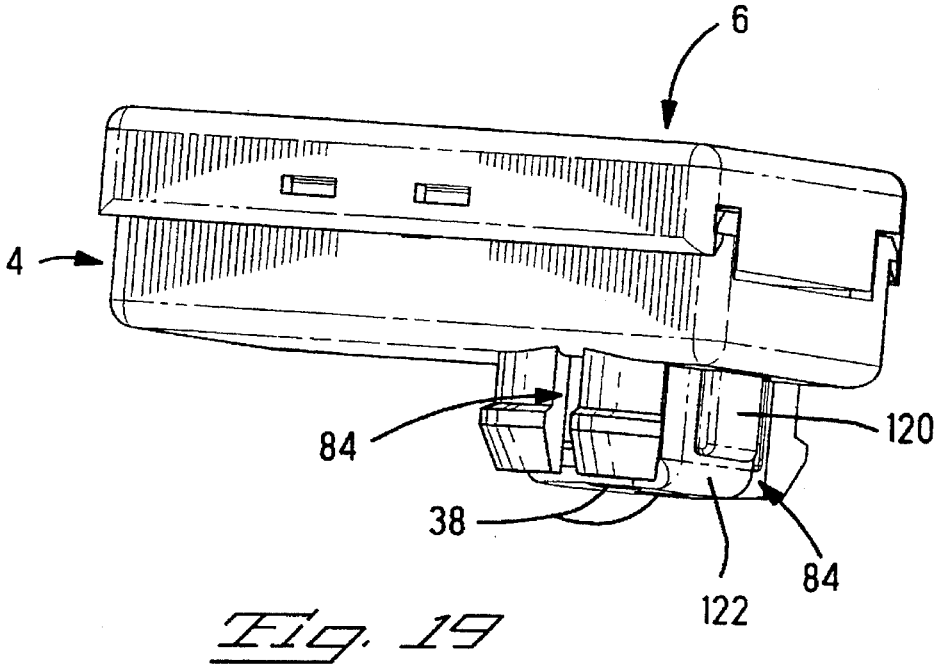
FIG. 19 is an isometric view of the connector of FIG. 18, taken from the side.
Figure 20:
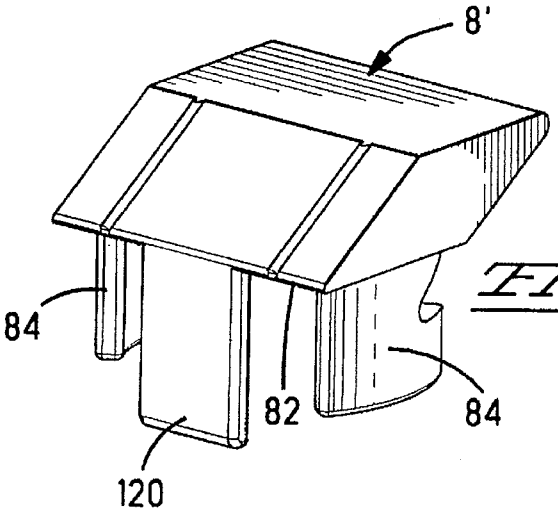
FIG. 20 is an isometric view of a support element of the connector of FIGS. 18 and 19.

A further embodiment of the invention will now be described with reference to FIGS. 18 to 23 in which parts which are similar to those described above with reference to FIGS. 1 to 12 bear the same reference numerals thereas. As shown in FIGS. 18 to 20 the support element 8' has a short-circuiting link displacement leg 120 depending from the base 82 between the support extensions 84 and being slidable along a flat front face 122 of the plug 36'. The leg 120 is of rectangular cross section.

Figure 21:
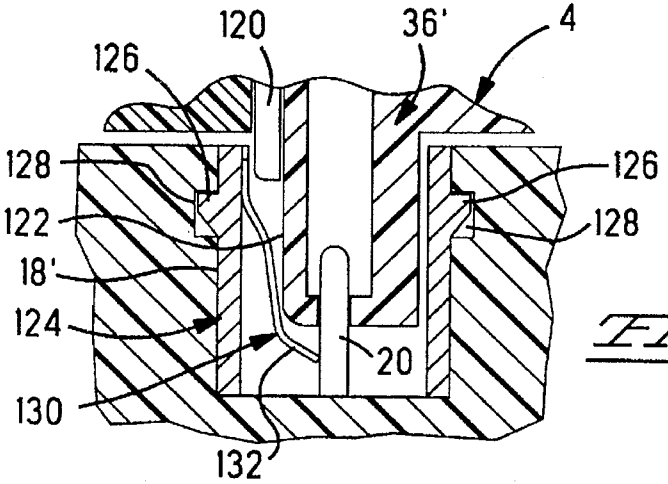
FIG. 21 is a fragmentary sectional view showing a plug of the connector of FIGS. 18 to 20 mated with a socket of a base unit, the socket containing a short circuiting link.
Figure 22:
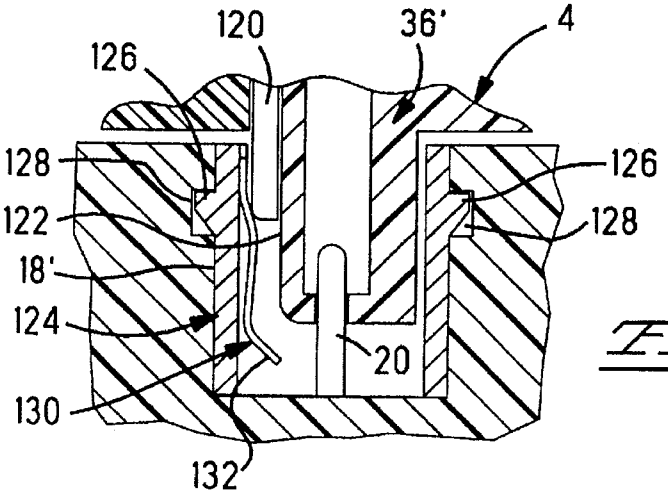
FIG. 22 is a view showing details of FIG. 21 but with the short circuiting link disabled.
Figure 23:
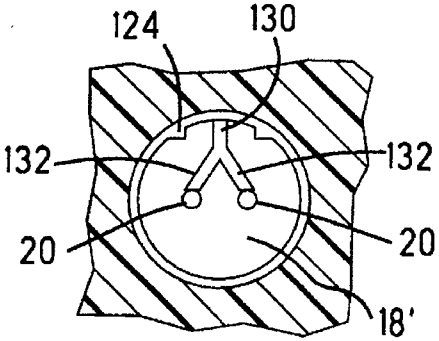
FIG. 23 is a plan view of the socket of FIGS. 21 and 22.

As shown in FIGS. 21 to 23, the socket 18' of the base unit contains an insulating moulding 124 secured in the socket by means of latches 126 engaged in recesses 128 in the moulding 124. There is secured in the moulding 124 a spring metal short-circuiting link 130 having a pair of spring contact arms 132 normally projected across the socket 18' and each engaging a respective one of the conductors 20, as shown in FIG. 23, and thereby short-circuiting the conductors 20 and thus disabling the air bag actuating circuit.

When the plug 36' is mated with the socket 18' with the slide 6 in its first position, the leg 120 of the support element 8' is in a raised position (FIG. 21) as are the support extensions 84 of the element 8'. When the slide 6 is advanced to its second position the extensions 84 are moved down to lock the plug in its mating relationship with the socket as described above, and the leg 120 is moved down between the spring arms 132 of the link 130, and the front face 122 of the plug, thereby displacing the spring arms 132 from the conductors 20 (FIG. 22) and thus disabling the link 130 and enabling the air bag actuating circuit. The actuating circuit cannot, therefore, be enabled until the connector has been locked to the base unit. In this embodiment, also, a warning lamp may be arranged to be illuminated on the dash board of the vehicle while the conductors 20 are short-circuited, as an indication that the actuating circuit is disabled.

Figure 24:
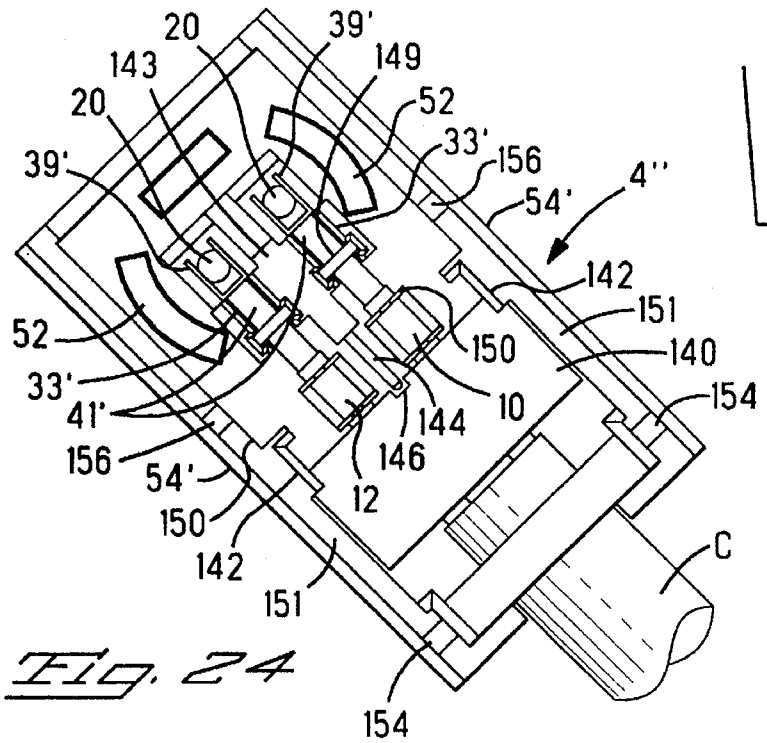
FIG. 24 is a plan view of yet another embodiment of the connector, incorporating a ferrite filter bead.
Figure 27:
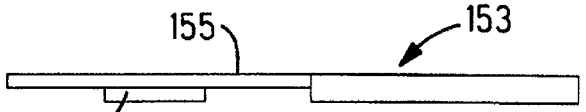
FIG. 27 is a side view of a lid for the connector of FIG. 25.

Yet a further embodiment of the connector will now be described with reference to FIGS. 24 and 25 in which parts which are similar to those described above with reference to FIGS. 1 to 12 bear the same reference numerals thereas. The housing 4" contains a ferrite filter bead 140 which is located in the open interior of the housing by means of a pair of flanges 142 projecting inwardly from the upper margins of the side walls of t housing 4" and a key 144 extending from a rib 143 between the terminals 41' and engaging in a recess 146 in the bead 140 which has through bores 148 through which the leads 10 and 12 extending from the cable C pass. The terminals 41' have slotted plate (IDC) contacts 150 into which the end portions of the leads have been forced. Each terminal is received in a groove 33' and has a forked contact end 39' for engaging about a respective conductor 20. The terminals are downwardly bent into the grooves at 149. The slide rails 54' extend along the full length of the housing on each side thereof, as do flat ledges 151 for receiving a loose piece lid 153 (FIG. 27) held in position longitudinally of the housing by means of opposed shoulders 154 and 156. The lid 153 has a reduced cross section portion 155 with a terminal position assurance rib 157.

Figure 25:
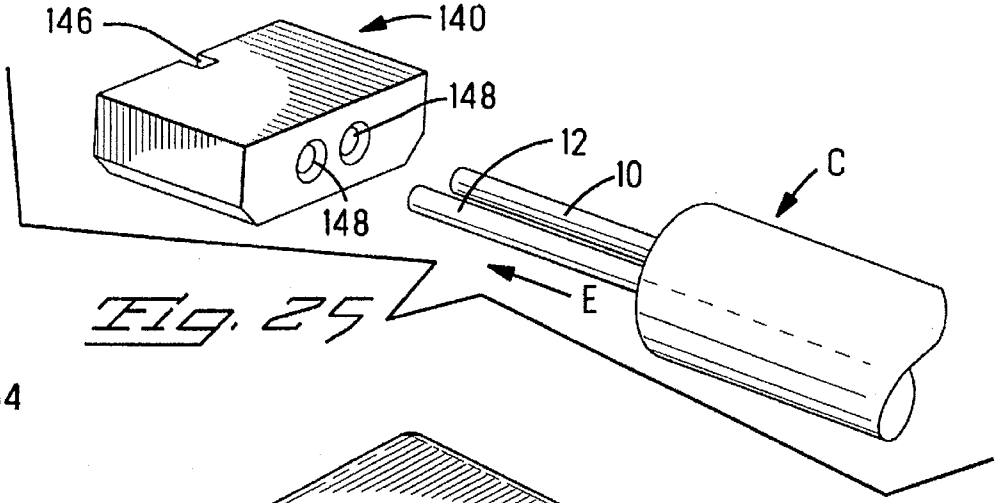
FIG. 25 is an isometric view of the bead showing leads about to be inserted through bores in the bead.

When assembling the terminals 41' and the bead 140 to the housing, the free end portions of the leads 10 and 12 are first inserted through the bores 148 of the bead 140 as indicated by the arrow E in FIG. 25 and the bead is inserted into the housing. The ends of the leads, which project from the bores 148 are then forced into the slots of the contacts 150 of the terminals, which have been secured in the grooves and a metal strain relief sleeve 152 is crimped about the cable C.

Figure 26:
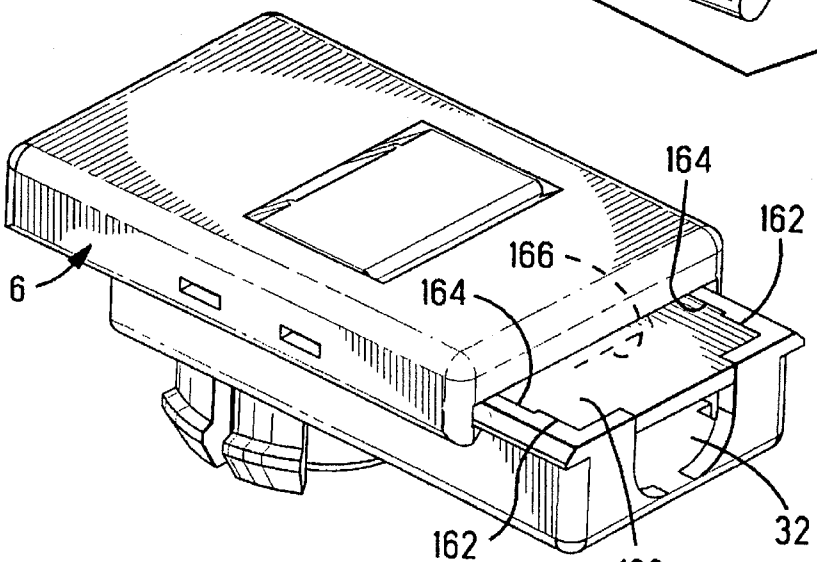
FIG. 26 is an isometric view taken from above of yet a further embodiment of the connector.

In the embodiment of FIG. 26 which shows the slide 6 in its first position a loose piece lid 160 is secured on the housing by means of lateral stepped recesses 162 in the upper margins of the side walls of the housing, into which recesses lateral margins 164 of the lid 160 are fitted. The lid 160 has a transverse terminal position assurance rib 166, shown in broken lines, on its underside.

I claim:

1. An electrical connector matable with a base unit where the base unit has a plurality of contacts disposed within a socket, the connector comprises; a housing having a body, a plug extending outward from the body that is receivable in the socket, and a deflectable retention member extending outward from the body alongside and spaced from the plug for engaging a retention feature in the base unit to retain the connector therewith; contacts disposed within the housing and accessible through the plug for engaging the contacts of the base unit when the connector is mated therewith; a slide slidably mounted to said housing and movable between a first position and a second position; and a support element responsive to slide movement that includes an extension that in the first position of the slide is disposed clear of the retention member to allow mating and demating of the connector with the base unit and in the second position the extension is disposed between the retention member and the plug thereby preventing deflection of the retention member thereby preventing mating or demating; the connector being characterized in that the extension is displaceable axially along the retention member and plug in response to movement of the slide between the first position and the second position.

2. The electrical connector of claim 1, further characterized in that the slide and the support element are separate elements having complementary camming components thereupon such that support element is driven transverse to the direction of movement of the slide.

3. The electrical connector of claim 2, further characterized in that the connector includes at least one pair of retention members spaced alongside the plug and depending from an underside of the body where the support element is generally U-shaped with a pair of extensions extending from a head where the head of the support element is positioned within the body and the extensions extend through cutouts in the underside thereof.

4. The electrical connector of claim 3, further characterized in that the head of the support element is exposed through an opening of upper wall of the body, the head having an upper surface that is more exposed in the first position of the slide than when the slide is in the second position thereby providing a visual indicia of the position of the extensions when the upper wall of the connector is viewed.

5. The electrical connector of claim 2, further characterized in that the support element further includes a leg that moves in conjunction with the extension, the leg extending in the same direction as the extension, where the leg interferes with a shorting circuit link in the base unit that forms a short circuit between at least two of the contacts in the socket such that the short circuit is defeated when the slide is moved to the second position while the connector is positively mated with the base unit.

6. The electrical connector of claim 2 further characterized in that the slide includes a bridge contact element and at least one of the contacts within the connector housing includes an interruption therein, said contact element being configured such that when the slide is in the first position the interruption is intact and when the slide is in the second position the interruption is defeated thereby completing the circuit only when the connector is positively retained upon the base unit.

7. The electrical connector of claim 6, further characterized in that the bridge contact element is conductive and forms an electrical bridge across the interruption.

8. The electrical connector of anyone of claim 1 further characterized in that the connector further includes a contact position assurance member that cooperates with the contacts and the slide such that the slide is operable only with the contacts properly positioned therein.

9. The electrical connector of claim 2 further characterized in that complementary camming components are oppositely angled surfaces.

10. The electrical connector of claim 4 further characterized in that the upper surface of the support element is accessible from the upper wall of the connector.

* * * * *